US009423742B1

(12) United States Patent
Nishida et al.

(10) Patent No.: US 9,423,742 B1
(45) Date of Patent: Aug. 23, 2016

(54) IMAGE FORMING APPARATUS AND FIXING DEVICE

(71) Applicant: FUJI XEROX CO., LTD., Tokyo (JP)

(72) Inventors: Haruhiko Nishida, Kanagawa (JP); Jun Sawamura, Kanagawa (JP); Takayuki Ukawa, Kanagawa (JP); Hideki Sato, Kanagawa (JP); Yoshiro Konishi, Kanagawa (JP); Yasuhiro Kato, Kanagawa (JP); Masahiro Akatsuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/857,235

(22) Filed: Sep. 17, 2015

(30) Foreign Application Priority Data

Feb. 17, 2015 (JP) ..... 2015-028307

(51) Int. Cl.
*G03G 15/20* (2006.01)
*G03G 21/16* (2006.01)

(52) U.S. Cl.
CPC ..... *G03G 15/2089* (2013.01); *G03G 15/2032* (2013.01); *G03G 15/2067* (2013.01); *G03G 21/1685* (2013.01)

(58) Field of Classification Search
CPC ..... G03G 15/2032; G03G 15/2067; G03G 15/6588; G03G 21/1685; G03G 2221/1639; G03G 15/2089
USPC ..... 399/122, 45
See application file for complete search history.

(56) References Cited

U.S. PATENT DOCUMENTS

| | | | | |
|---|---|---|---|---|
| 7,894,734 | B2 | 2/2011 | Sawamura et al. | |
| 2008/0069589 | A1* | 3/2008 | Chang | G03G 21/1685 399/122 |
| 2008/0310866 | A1* | 12/2008 | Kim | G03G 15/2064 399/122 X |
| 2009/0060571 | A1* | 3/2009 | Kang | G03G 1/1685 399/122 |
| 2014/0294415 | A1* | 10/2014 | Maruta | G03G 21/1685 399/122 X |
| 2014/0348542 | A1* | 11/2014 | Yoshida | G03G 21/1685 399/122 |

FOREIGN PATENT DOCUMENTS

| | | |
|---|---|---|
| JP | 2007-025571 A | 2/2007 |
| JP | 2011-023255 A | 2/2011 |
| JP | 2011-028298 A | 2/2011 |

* cited by examiner

*Primary Examiner* — Sophia S Chen
(74) *Attorney, Agent, or Firm* — Sughrue Mion, PLLC

(57) ABSTRACT

An image forming apparatus includes an image forming portion and a fixing device. The image forming portion forms a developer image on a recording medium. The fixing device is removably mounted to an image forming apparatus body, and fixes the developer image formed by the image forming portion to the recording medium. The fixing device includes a first rotator, a second rotator, and a pressing mechanism. The second rotator contacts the first rotator to form an interposition region in which the recording medium is interposed between the first rotator and the second rotator. The pressing mechanism presses the first rotator and the second rotator against each other. The image forming apparatus further includes a change mechanism that changes a force with which the pressing mechanism presses the first rotator and the second rotator against each other. The change mechanism is mounted to the image forming apparatus body.

8 Claims, 7 Drawing Sheets

IMAGE FORMING APPARATUS AND FIXING DEVICE

CROSS-REFERENCE TO RELATED APPLICATIONS

This application is based on and claims priority under 35 USC 119 from Japanese Patent Application No. 2015-028307 filed Feb. 17, 2015.

BACKGROUND

Technical Field

The present invention relates to an image forming apparatus and a fixing device.

SUMMARY

According to an aspect of the present invention, there is provided an image forming apparatus including: an image forming portion that forms a developer image on a recording medium; and a fixing device that is removably mounted to an image forming apparatus body and that fixes the developer image formed by the image forming portion to the recording medium, in which the fixing device includes a first rotator, a second rotator that contacts the first rotator to form an interposition region in which the recording medium is interposed between the first rotator and the second rotator, and a pressing mechanism that presses the first rotator and the second rotator against each other, the image forming apparatus further includes a change mechanism that changes a force with which the pressing mechanism presses the first rotator and the second rotator against each other, and the change mechanism is mounted to the image forming apparatus body.

BRIEF DESCRIPTION OF THE DRAWINGS

An exemplary embodiment of the present invention will be described in detail based on the following figures, wherein.

DETAILED DESCRIPTION

Figure 1:
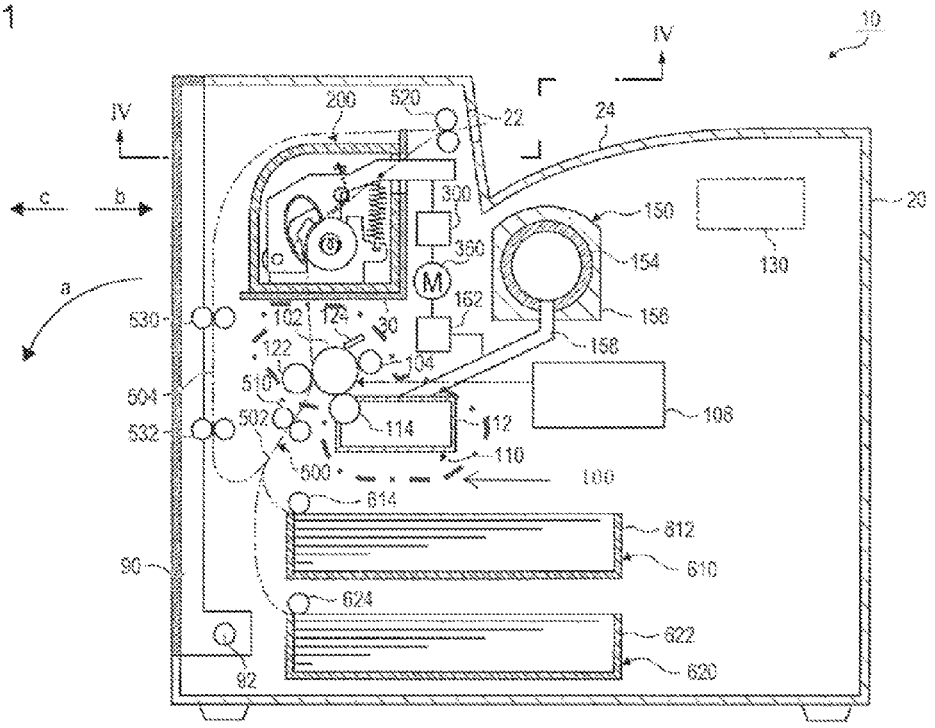
FIG. 1 illustrates a schematic configuration of an image forming apparatus according to an exemplary embodiment of the present invention.

Now, an exemplary embodiment of the present invention will be described with reference to the drawings. FIG. 1 illustrates an image forming apparatus 10 according to an exemplary embodiment of the present invention. As illustrated in FIG. 1, the image forming apparatus 10 includes an image forming apparatus body 20. An ejection port 22 that ejects paper used as a recording medium is formed in the image forming apparatus body 20. The upper surface of the image forming apparatus body 20 is used as an ejection portion 24 to which a recording medium to which a developer image has been fixed is ejected. The term "recording medium" refers to a member to which a developer image may be fixed for recording. Specific examples of the recording medium include regular paper and an envelope.

The image forming apparatus body 20 includes a tie plate 30 used as a fixed portion to which a fixing device 200 to be discussed later is fixed. With the fixing device 200 fixed to the tie plate 30, the fixing device 200 is accurately positioned in the image forming apparatus body 20, and reinforced.

An open/close portion 90 is mounted to the left side (left side in FIG. 1) of the image forming apparatus body 20 so as to be rotatable about a hinge 92 to be openable/closable with respect to the image forming apparatus body 20. FIG. 1 illustrates a state in which the open/close portion 90 is closed with respect to the image forming apparatus body 20. The open/close portion 90 is opened with respect to the image forming apparatus body 20 by rotating the open/close portion 90 about the hinge 92 in the direction of the arrow a indicated in FIG. 1 from the state illustrated in FIG. 1.

An image forming portion 100 that forms a developer image on paper is disposed in the image forming apparatus body 20. The image forming portion 100 includes a photosensitive drum 102, a charging device 104, a latent image forming device 106, a developing device 110, a transfer device 122, and a cleaning device 124. The photosensitive drum 102 is used as an image holding element that holds an image. The charging device 104 uniformly charges a surface of the photosensitive drum 102. The latent image forming device 106 forms an electrostatic latent image on the surface of the photosensitive drum 102 uniformly charged by the charging device 104. The developing device 110 develops the latent image formed by the latent image forming device 106 using a developer. The transfer device 122 transfers the developer image, which has been formed on the surface of the photosensitive drum 102 by the developing device 110 developing the latent image, to paper. The cleaning device 124 cleans the developer or the like remaining on the surface of the photosensitive drum 102 after the developer image is transferred to the paper by the transfer device 122.

All or some of the photosensitive drum 102, the charging device 104, the latent image forming device 106, the developing device 110, and the cleaning device 124 may be accommodated in a single structure to be used as a so-called process cartridge. The process cartridge may be mounted to and removed from the image forming apparatus body 20.

The developing device 110 includes a developing device body 112 and a developing roller 114 that holds the developer and that supplies the developer to the photosensitive drum 102. In the exemplary embodiment, a so-called two-component developing device is used as the developing device 110. The developing device 110 develops a latent image using a two-component developer composed of a non-magnetic toner and a magnetic toner. More specifically, the developing device 110 electrostatically moves the toner in a charged state in the developer to the photosensitive drum 102 to develop the latent image.

A toner replenishment device 150 is disposed in the image forming apparatus body 20. The toner replenishment device 150 replenishes the developing device 110 with the toner in the case where the concentration of the toner in the developer accommodated in the developing device body 112 has been lowered, for example. The toner replenishment device 150 includes a toner accommodation container 154, a toner replenishment device body 156, and a transport path 158. The toner accommodation container 154 accommodates the toner. The toner accommodation container 154 is mounted to and removed from the toner replenishment device body 156. The toner is transported to the developing device 110 through the transport path 158. A toner transport member (not illustrated) that is rotatable to transport the toner, for example, is disposed in the transport path 158.

The fixing device 200 which fixes the developer image formed on the paper by the image forming portion 100 to the paper is disposed in the image forming apparatus body 20. The fixing device 200 is mountable to and removable from the image forming apparatus body 20, and fixed to the tie plate 30 with the fixing device 200 mounted to the image forming apparatus body 20.

To mount the fixing device 200 to the image forming apparatus body 20, the open/close portion 90 is opened with respect to the image forming apparatus body 20, and an operator inserts the fixing device 200 into the image forming apparatus body 20 in the direction of the arrow b indicated in FIG. 1 from the outside of the image forming apparatus body 20 toward the tie plate 30. To detach the fixing device 200 from the image forming apparatus body 20, the open/close portion 90 is opened with respect to the image forming apparatus body 20, and the fixing device 200 which has been fixed to the tie plate 30 is drawn out of the image forming apparatus body 20 in the direction of the arrow c indicated in FIG. 1.

The fixing device 200 is mounted to and removed from the image forming apparatus body 20 to replace the fixing device 200 which has been used so far with another fixing device 200, for example, because a fixing roller 204 to be discussed later or a fixing belt 230 to be discussed later has been degraded along with use, for example. The fixing device 200 will be discussed in detail later.

A paper feed device 610 and a paper feed device 620 are disposed in the image forming apparatus body 20. The paper feed device 610 supplies paper such as regular paper and an envelope (hereinafter referred to as "paper etc."), for example, to the image forming portion 100. The paper feed device 620 also supplies paper etc. to the image forming portion 100. The paper feed device 610 includes a paper accommodation portion 612 and a feeding device 614. The paper accommodation portion 612 accommodates paper etc. in a stacked state. The feeding device 614 feeds the paper etc. accommodated in the paper accommodation portion 612 to a transport path 500 to be discussed later. The paper feed device 620 includes a paper accommodation portion 622 and a feeding device 624. The paper accommodation portion 622 accommodates paper etc. in a stacked state. The feeding device 624 feeds the paper etc. accommodated in the paper accommodation portion 622 to the transport path 500 to be discussed later.

The paper accommodation portion 612 and the paper accommodation portion 622 may accommodate paper etc. of different types or sizes. Examples of the paper etc. of different types include paper of different thicknesses. Additional examples of the paper etc. of different types include regular paper and an envelope. To fix the developer to paper of different types such as paper of different thicknesses, it is desirable to employ different fixing conditions under which the fixing device 200 fixes a developer image to the paper.

The transport path 500 for transport of the paper etc. is formed in the image forming apparatus body 20. The transport path 500 includes a principal transport path 502 and a reverse transport path 504. The paper feed device 620 discussed earlier, the paper feed device 610 discussed earlier, a resist roller 510, the transfer device 122 discussed earlier and the photosensitive drum 102 discussed earlier, the fixing device 200 discussed earlier, and an ejection roller 520 are disposed along the principal transport path 502 in this order from the upstream side in the direction of transport of the paper etc. through the principal transport path 502.

The resist roller 510 temporarily stops movement of the distal end portion of the paper etc. supplied from one of the paper feed device 610 and the paper feed device 620, and resumes movement of the distal end portion of the paper etc. to a transfer portion formed by the photosensitive drum 102 and the transfer device 122 so as to match the timing when a toner image is formed on the surface of the photosensitive drum 102.

The transfer device 122 is applied with a transfer bias to electrostatically transfer the toner image, which has been formed on the surface of the photosensitive drum 102, to the paper etc.

The ejection roller 520 ejects the paper etc., to which the toner image has been fixed by the fixing device 200, toward the ejection portion 24 through the ejection port 22. To form a developer image on the other surface of paper etc., on one surface of which a developer image has been formed, the ejection roller 520 starts rotating in the opposite direction at the timing when a portion near the rear end portion of the paper etc. reaches the ejection roller 520, and the ejection roller 520 rotates in the opposite direction to feed the paper etc., on one surface of which a developer image has been formed, to the reverse transport path 504 from the rear end portion side.

Two transport rollers 530 and 532, for example, are disposed along the reverse transport path 504 in this order from the upstream side in the direction of transport of paper etc. in the reverse transport path 504. The transport roller 530 and the transport roller 532 transport the paper etc., on one surface of which a toner image has been formed, toward the resist roller 510 with the paper turned over.

An operation panel 130 used as an operation portion for operating the image forming apparatus 10 is attached to the front surface, for example, of the image forming apparatus body 20. The operation panel 130 is used by the operator to input information about image formation such as which of the paper feed device 610 and the paper feed device 620 supplies paper, for example.

A change mechanism 300 and a motor 360 are disposed in the image forming apparatus body 20. The change mechanism 300 changes a force with which the fixing roller 204 to be discussed later and the fixing belt 230 to be discussed later are pressed against each other. The motor 360 is used as a drive source that drives the change mechanism 300. The change mechanism 300 will be discussed in detail later.

A drive mechanism 162 that drives the toner transport member (not illustrated) disposed in the transport path 158 is disposed in the image forming apparatus body 20. A drive force is transmitted from the motor 360, which serves as the drive source for the change mechanism 300, to the drive mechanism 162. In this way, the drive source which drives the change mechanism 300 is also used as the drive source for the transport member which transports the toner from the toner replenishment device 150 to the developing device 110.

Figure 2:
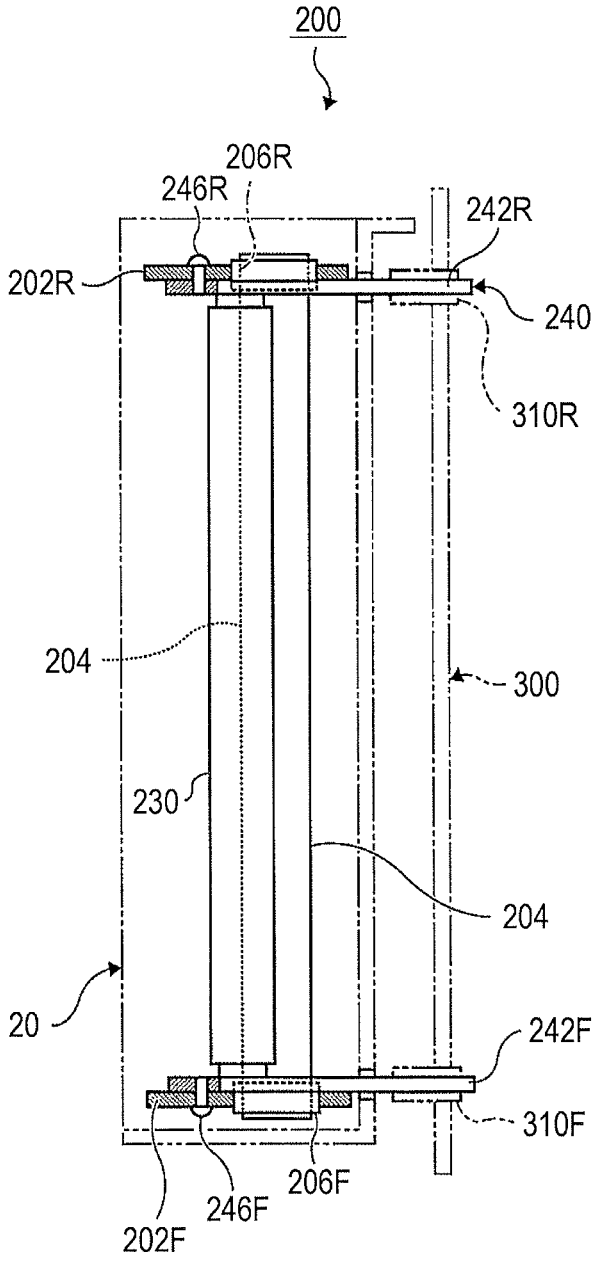
FIG. 2 is a plan view illustrating a fixing device of the image forming apparatus illustrated in FIG. 1.
Figure 3:
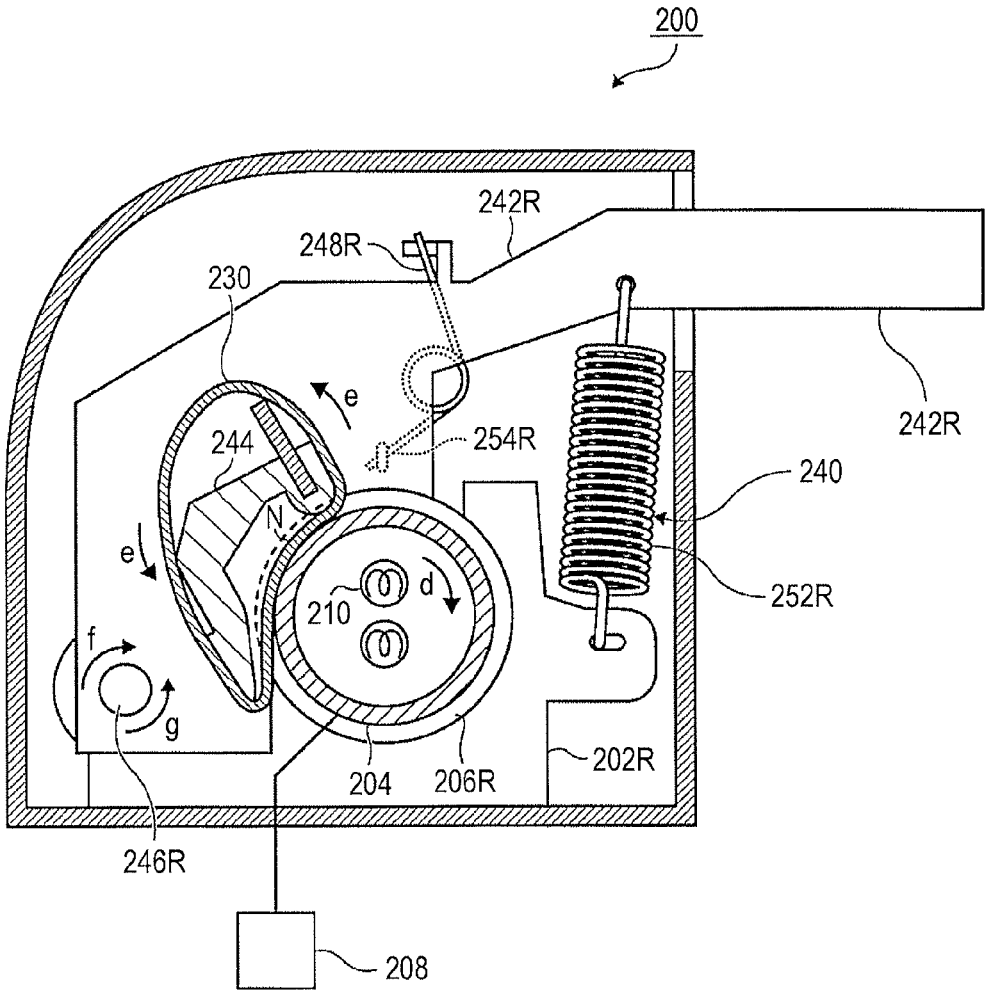
FIG. 3 is a vertical sectional view illustrating the fixing device illustrated in FIG. 2.

The fixing device 200 is illustrated in FIGS. 2 and 3. As illustrated in FIGS. 2 and 3, the fixing device 200 includes a rear side plate 202R, a front side plate 202F, and the fixing roller 204. The rear side plate 202R is a side plate positioned on the rear side. The front side plate 202F is a side plate positioned on the front side. The fixing roller 204 is used as a first rotator. The fixing roller 204 is supported such that the rear end portion side thereof is rotatable with respect to the rear side plate 202R via a bearing 206R. The fixing roller 204 is supported such that the front end portion side thereof is rotatable with respect to the front side plate 202F via a bearing 206F.

A drive source 208 such as a motor, for example, is coupled to the fixing roller 204. The fixing roller 204 receives a drive force transmitted from the drive source 208 to be rotated in the direction of the arrow d indicated in FIG. 3. The fixing roller 204 has a cylindrical shape. A heat source 210 is disposed in a hollow portion of the fixing roller 204. A halogen lamp or the like may be used as the heat source 210.

The fixing device 200 includes the fixing belt 230. The fixing belt 230 is used as a second rotator that contacts the fixing roller 204 to form an interposition region N in which paper is interposed between the fixing roller 204 and the fixing belt 230. The fixing belt 230 is a flexible endless belt-like member, and is rotatably supported by a belt support portion 244 disposed inside the fixing belt 230. The fixing belt 230 is driven by rotation of the fixing roller 204 in the direction of the arrow d to be rotated in the direction of the arrow e indicated in FIG. 4.

The fixing device 200 includes a pressing mechanism 240 that presses the fixing roller 204 and the fixing belt 230 against each other. The pressing mechanism 240 includes a rear lever member 242R, a front lever member 242F, and the belt support portion 244 discussed earlier. The rear lever member 242R and the front lever member 242F are used as a movable member that is movable by the action of the change mechanism 300 (see FIG. 1).

The rear lever member 242R is supported so as to be rotatable with respect to the rear side plate 202R by a rear shaft member 246R. The front lever member 242F is attached so as to be rotatable with respect to the front side plate 202F by a front shaft member 246F. The belt support portion 244 supports the fixing belt 230. The rear end portion of the belt support portion 244 is fixed to the rear lever member 242R. The front end portion of the belt support portion 244 is fixed to the front lever member 242F.

With the configuration described above, the belt support portion 244, the fixing belt 230, the rear lever member 242R, and the front lever member 242F are integrally rotatable and swingable in the direction of the arrow f indicated in FIG. 3 and the direction of the arrow g indicated in FIG. 3 about the rear shaft member 246R and the front shaft member 246F with respect to the rear side plate 202R and the front side plate 202F.

The pressing mechanism 240 includes a first torsion spring 248R (i.e., rear torsion spring) used as a first urging unit and a second torsion spring (i.e., front torsion spring that is not illustrated) also used as the first urging unit. The pressing mechanism 240 also includes a first coil spring 252R (i.e., a rear coil spring) used as a second urging unit and a second coil spring (i.e. a front coil spring that is not illustrated) also used as the second urging unit. The first torsion spring 248R, the second torsion spring, the first coil spring 252R, and the second coil spring are members that press one of the fixing roller 204 and the fixing belt 230 against the other of the fixing roller 204 and the fixing belt 230. In the exemplary embodiment, the members are used to press the fixing belt 230 against the fixing roller 204.

One end portion of the first torsion spring 248R is coupled to the rear lever member 242R. The other end portion of the torsion first spring 248R is fixed to a fixing portion 254R. The fixing portion 254R is formed on a member (not illustrated) mounted to the rear side plate 202R, and has a projected shape, for example. The torsion first spring 248R urges the rear lever member 242R etc. so as to rotate in the direction of the arrow f. One end portion of the second torsion spring is coupled to the front lever member 242F. The other end portion of the second torsion spring is fixed to another fixing portion (not illustrated). The other fixing portion is formed on another member (not illustrated) mounted to the front side plate 202F, and has a projected shape, for example. The second torsion spring urges the front lever member 242F etc. so as to rotate in the direction of the arrow f.

One end portion of the first coil spring 252R is coupled to the rear lever member 242R. The other end portion of the first coil spring 252R is fixed to the rear side plate 202R. The first coil spring 252R urges the rear lever member 242R etc. so as to rotate in the direction of the arrow f. One end portion of the second coil spring is coupled to the front lever member 242F. The other end portion of the second coil spring is fixed to the front side plate 202F. The second coil spring urges the front lever member 242F etc. so as to rotate in the direction of the arrow f.

Figure 4:
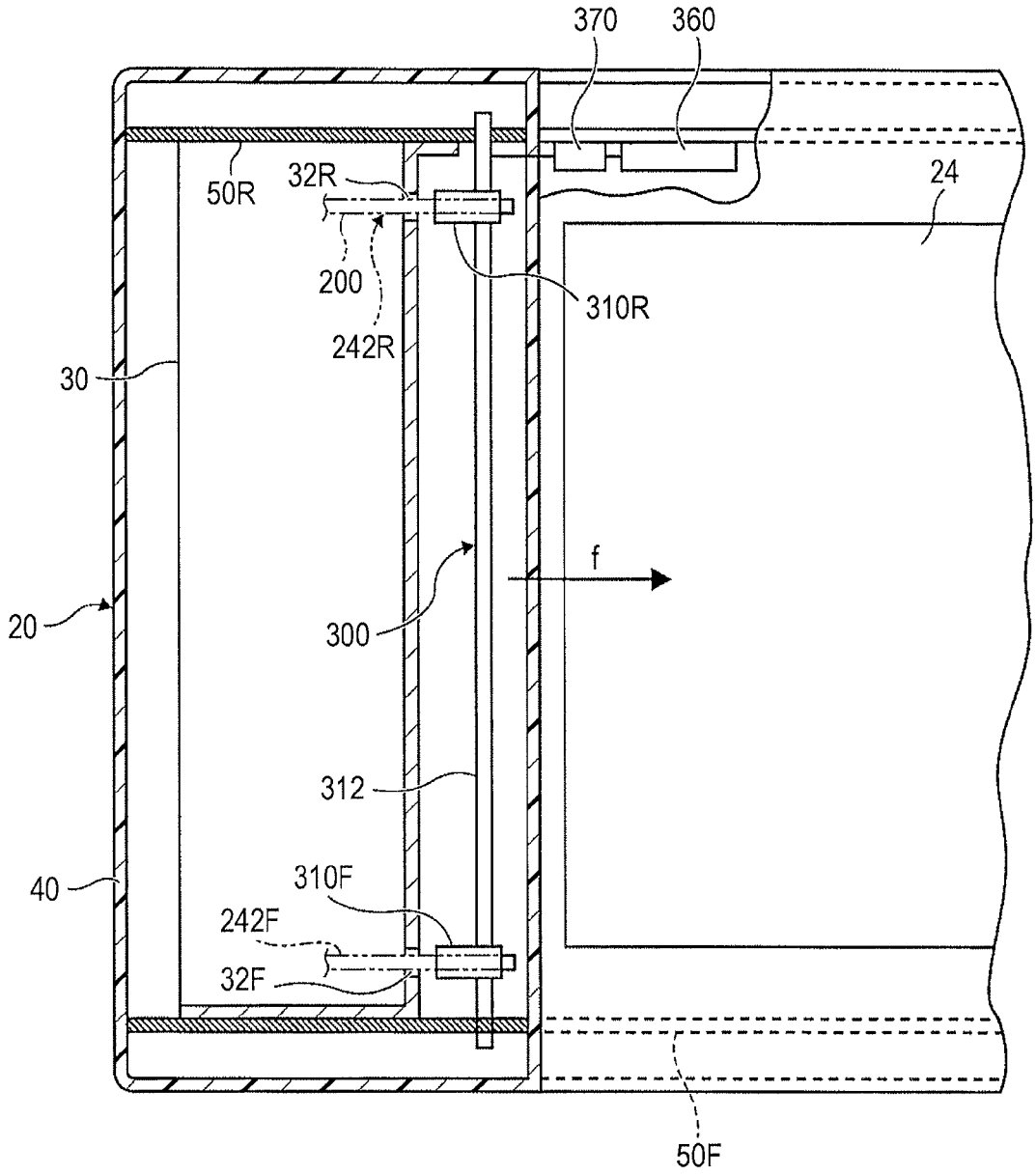
FIG. 4 illustrates a section of the image forming apparatus illustrated in FIG. 1 taken along the line IV-IV of FIG. 1.

The rear lever member 242R, the front lever member 242F, the belt support portion 244, and the fixing belt 230 are integrally urged by at least one of the first torsion spring 248R and the second torsion spring and the first coil spring 252R and the second coil spring so as to be rotated in the direction of the arrow f indicated in FIG. 4 so that the fixing belt 230 is pressed against the fixing roller 204.

In FIG. 2 which is a plan view illustrating the fixing device 200, in order to illustrate the positional relationship between the fixing device 200 and the other members with the fixing device 200 mounted to the image forming apparatus body 20 (see FIG. 1), a rear cam member 310R to be discussed later which is a member of the change mechanism 300, a front cam member 310F to be discussed later which is also a member of the change mechanism 300, and the image forming apparatus body 20 are illustrated by the phantom lines (double-dashed lines).

FIG. 4 illustrates a section of the image forming apparatus 10 taken along the line IV-IV of FIG. 1 with the fixing device 200 detached from the image forming apparatus body 20. In FIG. 4, in order to illustrate the positional relationship between the change mechanism 300 and the fixing device 200, a part of the fixing device 200 is illustrated by the phantom lines (double-dashed lines).

As illustrated in FIG. 4, the image forming apparatus body 20 forms an outer frame of the image forming apparatus 10, and includes an outer covering portion 40 manufactured by shaping a resin or the like, for example. The image forming apparatus body 20 includes a rear frame portion 50R and a front frame portion 50F. The rear frame portion 50R is disposed on the rear side in a space surrounded by the outer covering portion 40, and made of metal, for example. The front frame portion 50F is disposed on the front side in the space surrounded by the outer covering portion 40, and made of metal, for example. The tie plate 30 discussed earlier is fixed to the rear frame portion 50R and the front frame portion 50F to be supported by the rear frame portion 50R and the front frame portion 50F.

As illustrated in FIG. 4, the change mechanism 300 includes the rear cam member 310R (also see FIG. 6) and the front cam member 310F. The rear cam member 310R is positioned on the rear side in the image forming apparatus body 20. The front cam member 310F is positioned on the front side in the image forming apparatus body 20. The rear cam member 310R and the front cam member 310F are fixed to a coupling shaft 312, and coupled to each other by the coupling shaft 312.

Figure 6:
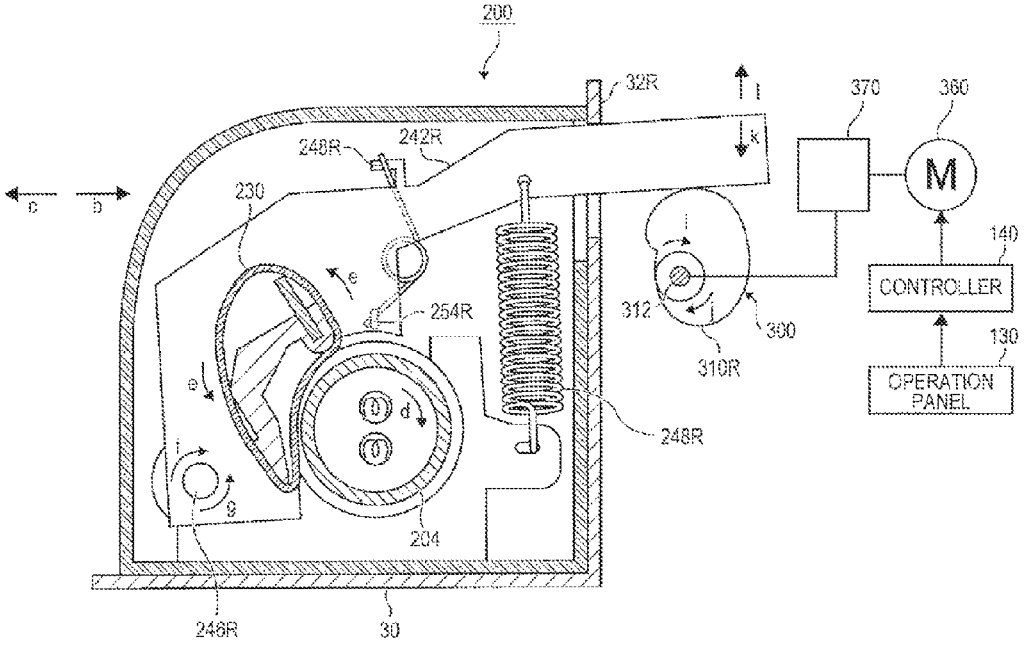
FIG. 6 illustrates the configuration and operation of a change mechanism of the image forming apparatus illustrated in FIG. 1.

The position at which the rear cam member 310R is fixed to the coupling shaft 312 is determined such that the rear cam member 310R and the rear lever member 242R may contact each other (also see FIG. 6). The position at which the front cam member 310F is fixed to the coupling shaft 312 is determined such that the front cam member 310F and the front lever member 242F may contact each other.

The rear end portion side of the coupling shaft 312 is rotatably supported by the rear frame portion 50R. The front end portion side of the coupling shaft 312 is rotatably supported by the front frame portion 50F. Therefore, the rear cam member 310R, the front cam member 310F, and the coupling shaft 312 are rotatable with respect to the image forming apparatus body 20 in the direction of the arrow i indicated in FIG. 6 and the direction of the arrow j indicated in FIG. 6.

As illustrated in FIG. 4, the change mechanism 300 which is composed of the rear cam member 310R and the front cam member 310F is disposed between the tie plate 30 and the ejection portion 24 in the direction indicated by the arrow f in FIG. 4 in which the paper is ejected to the ejection portion 24. As illustrated in FIG. 4, the change mechanism 300 is disposed on the outer side with respect to the ejection portion 24 in the direction of the width of the ejection portion 24 which crosses the direction indicated by the arrow f in which the paper is ejected to the ejection portion 24.

The motor 360 is attached to the rear frame portion 50R of the image forming apparatus body 20. The motor 360 is coupled to the coupling shaft 312 via a drive transmission mechanism 370 such as a gear train, for example. The motor 360 transmits a drive force to integrally rotate the rear cam member 310R, the front cam member 310F, and the coupling shaft 312 with respect to the image forming apparatus body 20.

As with the motor 360, the drive transmission mechanism 370 is attached to the rear frame portion 50R. Although the drive transmission mechanism 370 is composed of a gear train etc. as discussed earlier, the drive transmission mechanism 370 is illustrated schematically in FIG. 4 with gears etc. composing the gear train discussed above not illustrated.

Figure 5:
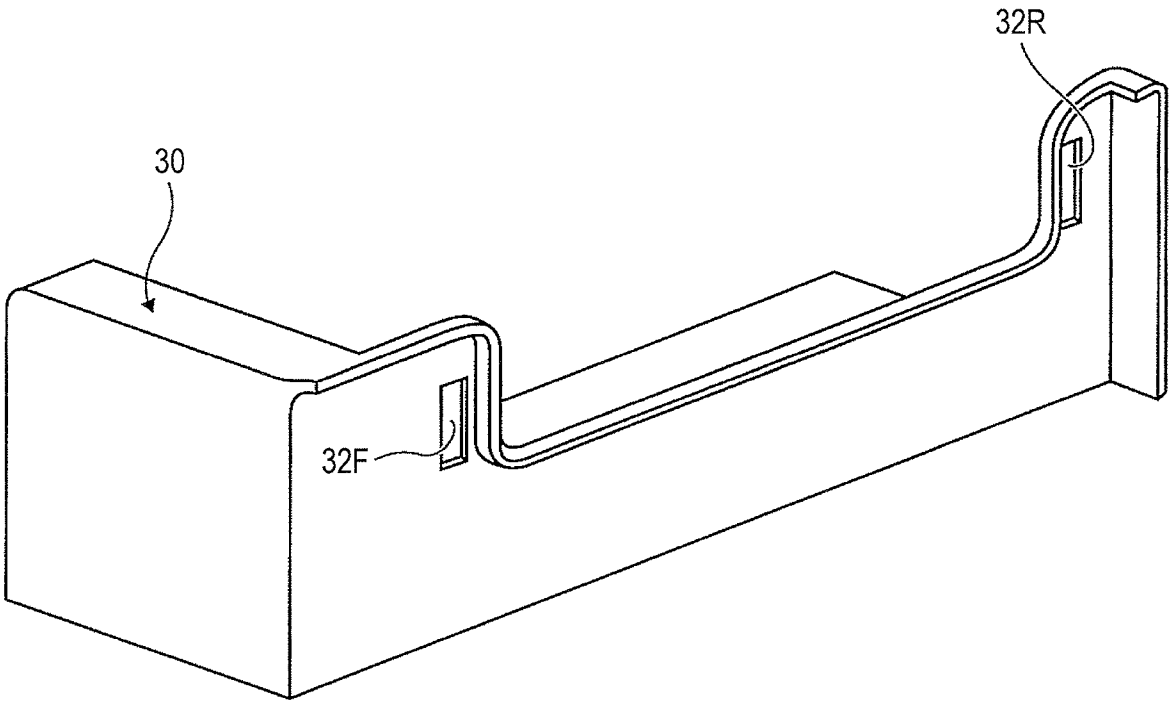
FIG. 5 is a perspective view illustrating a tie plate of the image forming apparatus illustrated in FIG. 1.

The tie plate 30 includes a rear opening portion 32R formed at a position on the rear side and a front opening portion 32F formed at a position on the front side (also see FIG. 5). The rear lever member 242R is disposed to pass through the rear opening portion 32R to project from the side of the fixing device 200 with respect to the tie plate 30 to the side of the change mechanism 300 with respect to the tie plate 30. The front lever member 242F is disposed to pass through the front opening portion 32F to project from the side of the fixing device 200 with respect to the tie plate 30 to the side of the change mechanism 300 with respect to the tie plate 30.

FIG. 5 illustrates the tie plate 30. As discussed earlier, the tie plate 30 includes the rear opening portion 32R formed on the rear side and the front opening portion 32F formed on the front side.

FIG. 6 illustrates the configuration and operation of the change mechanism 300. The change mechanism 300 operates with the motor 360 controlled by a controller 140, for example, on the basis of an input from the operation panel 130, for example.

The controller 140 includes a control circuit including a central processing unit (CPU), for example, and determines a fixing condition on the basis of which of the paper feed device 610 and the paper feed device 620 is selected by the input to the operation panel 130, and controls the motor 360 on the basis of the determined fixing condition. That is, in the case where the paper feed device 610 is selected, the motor 360 is controlled so as to achieve a fixing condition that is suitable for the paper accommodated in the paper feed device 610. In the case where the paper feed device 620 is selected, the motor 360 is controlled so as to achieve a fixing condition that is suitable for the paper accommodated in the paper feed device 620.

The motor 360 is rotated on the basis of the control by the controller 140 to rotate the rear cam member 310R and the front cam member 310F (see FIG. 2) in the direction of the arrow i or the direction of the arrow j indicated in FIG. 6. When the rear cam member 310R and the front cam member 310F are rotated, the right end side of the rear lever member 242R and the front lever member 242F (see FIG. 2) is moved in the direction of the arrow k indicated in FIG. 6 or the direction of the arrow l indicated in FIG. 6.

Instead of the motor 360 rotating the rear cam member 310R and the front cam member 310F in the direction of the arrow i or the direction of the arrow j indicated in FIG. 6, the motor 360 may rotate the rear cam member 310R and the front cam member 310F only in the direction of the arrow i or the direction of the arrow j indicated in FIG. 6.

The direction of the arrow k and the direction of the arrow l, in which the change mechanism 300 moves the right end portion side of the rear lever member 242R and the right end portion side of the front lever member 242F, cross the direction of the arrow b and the direction of the arrow c (also see FIG. 1), in which the fixing device 200 is mounted to and removed from the image forming apparatus body 20.

Figure 7A:
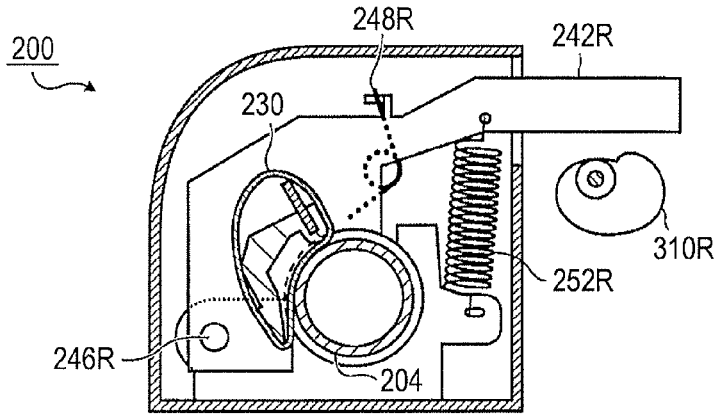
FIG. 7A illustrates operation of the change mechanism of the image forming apparatus illustrated in FIG. 1, illustrating a state of the fixing device at the time when a developer image is fixed to regular paper.
Figure 7B:
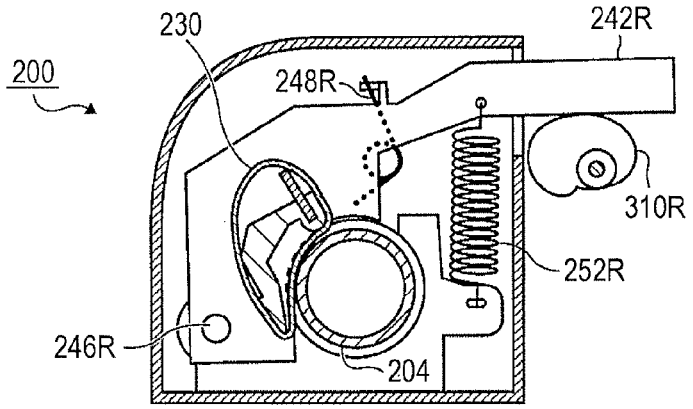
FIG. 7B illustrates operation of the change mechanism of the image forming apparatus illustrated in FIG. 1, illustrating a state of the fixing device at the time when a developer image is fixed to an envelope.
Figure 7C:
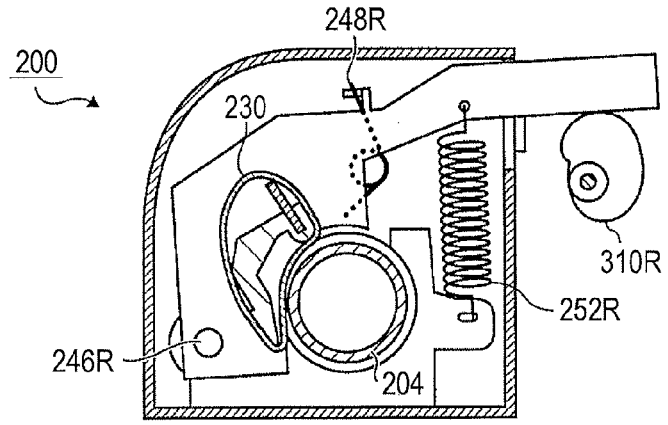
FIG. 7C illustrates operation of the change mechanism of the image forming apparatus illustrated in FIG. 1, illustrating a state of the fixing device in which a force of pressing a first rotator and a second rotator against each other has been canceled.

FIGS. 7A to 7C illustrate operation of the change mechanism 300. FIG. 7A illustrates a state of the fixing device 200 at the time when a developer image is fixed to regular paper. FIG. 7B illustrates a state of the fixing device 200 at the time when a developer image is fixed to an envelope. FIG. 7C illustrates a state of the fixing device 200 in which a force of pressing the fixing roller 204 and the fixing belt 230 against each other has been canceled.

As illustrated in FIGS. 7A to 7C, the position of the rear lever member 242R is different among the state illustrated in FIG. 7A, the state illustrated in FIG. 7B, and the state illustrated in FIG. 7C. The rear lever member 242R is moved by the action of the rear cam member 310R which receives a drive force transmitted from the motor 360 as discussed earlier. Although the front lever member 242F is not illustrated in FIGS. 7A to 7C, the front lever member 242F is moved in the same manner as the rear lever member 242R together with the rear lever member 242R.

In the state illustrated in FIG. 7A, the rear cam member 310R is not in contact with the rear lever member 242R. The fixing belt 230 is pressed against the fixing roller 204 by the action of both the first torsion spring 248R and the second torsion spring (not illustrated) and the first coil spring 252R and the second coil spring (not illustrated).

In the state illustrated in FIG. 7B, the rear lever member 242R has been moved in the direction of the arrow g and the arrow l from the position illustrated in FIG. 7A by the action of the rear cam member 310R, and the front lever member 242F has been moved in the same manner as the rear lever member 242R. In the state illustrated in FIG. 7B, the force with which the first coil spring 252R presses the fixing belt 230 against the fixing roller 204 has been canceled by the movement of the rear lever member 242R, and the force with which the second coil spring presses the fixing belt 230 against the fixing roller 204 has been canceled by the movement of the front lever member 242F.

In the state illustrated in FIG. 7B, the fixing belt 230 is pressed against the fixing roller 204 by only the first torsion spring 248R and the second torsion spring. Therefore, in the state illustrated in FIG. 7B, the force with which the fixing belt 230 is pressed against the fixing roller 204 is small compared to the state illustrated in FIG. 7A.

In the state illustrated in FIG. 7C, the rear lever member 242R has been further moved in the direction of the arrow g and the arrow l from the position illustrated in FIG. 7B by the action of the rear cam member 310R, and the front lever member 242F has been moved in the same manner as the rear lever member 242R. In the state illustrated in FIG. 7C, the force with which the first torsion spring 248R presses the fixing belt 230 against the fixing roller 204 has been canceled by the movement of the rear lever member 242R, and the force with which the second torsion spring presses the fixing belt 230 against the fixing roller 204 has been canceled by the movement of the front lever member 242F.

Therefore, in the state illustrated in FIG. 7C, the fixing belt 230 is not pressed against the fixing roller 204 by any of the first torsion spring 248R and the second torsion spring and the first coil spring 252R and the second coil spring. In FIG. 7C, for convenience of illustration, the fixing belt 230 and the fixing roller 204 are illustrated as contacting each other. However, it is desirable that the fixing roller 204 and the fixing belt 230 should not contact each other in a state in which a force of pressing the fixing roller 204 and the fixing belt 230 against each other has been canceled.

With the image forming apparatus 10 configured as described above, the fixing roller 204 and the fixing belt 230 are replaced by replacing the fixing device 200. However, the change mechanism 300 and the motor 360 which are mounted to the image forming apparatus body 20 are not replaced together with the fixing device 200, and are continuously used also after a new fixing device 200 is mounted to the image forming apparatus body 20.

As has been described above, the present invention may be applied to an image forming apparatus such as a copier, a facsimile device, and a printer, for example, and a fixing device for use in such an image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming portion configured to form a developer image on a recording medium; and a fixing device that is removably mounted to an image forming apparatus body and configured to fix the developer image formed by the image forming portion to the recording medium, wherein the fixing device includes:

a first rotator, a second rotator configured to contact the first rotator to form an interposition region in which the recording medium is nipped between the first rotator and the second rotator, a pressing mechanism configured to press the first rotator and the second rotator against each other, and a change mechanism configured to change a force with which the pressing mechanism presses the first rotator and the second rotator against each other, the change mechanism being mounted to the image forming apparatus body, wherein the pressing mechanism includes a movable member that is movable by action of the change mechanism, wherein the charge mechanism is configured to change the force with which the pressing mechanism presses the first rotator and the second rotator by moving the movable member in a direction away from the first rotator when the changing member is in an engaged state, and wherein the moveable member is released from a target of the pressing operation.

2. The image forming apparatus according to claim 1, wherein the image forming apparatus body includes a fixed portion to which the fixing device is fixed, and wherein the movable member of the pressing mechanism passes through an opening portion formed in the fixed portion to project from a side of the fixing device with respect to the fixed portion to a side of the change mechanism with respect to the fixed portion.

3. The image forming apparatus according to claim 2, wherein the change mechanism moves the movable member in a direction that crosses a direction in which the fixing device is mounted to and removed from the image forming apparatus body.

4. The image forming apparatus according to claim 1, wherein the image forming apparatus body includes a fixed portion to which the fixing device is fixed, the image forming apparatus further includes an ejection portion to which the recording medium to which the developer image has been fixed is ejected, and the change mechanism is disposed between the fixed portion and the ejection portion in a direction in which the recording medium is ejected.

5. The image forming apparatus according to claim 1, wherein the image forming apparatus further includes an ejection portion to which the recording medium to which the developer image has been fixed is ejected, and the change mechanism is disposed on an outer side with respect to the ejection portion in a direction that crosses a direction in which the recording medium is ejected.

6. The image forming apparatus according to claim 1, further comprising:

a drive source configured to drive the change mechanism, wherein the drive source is mounted to the image forming apparatus body.

7. The image forming apparatus according to claim 1, wherein the pressing mechanism includes a first urging unit configured to urge one of the first rotator and the second rotator toward the other of the first rotator and the second rotator, and a second urging unit configured to urge the one of the first rotator and the second rotator toward the other of the first rotator and the second rotator, wherein the change mechanism is further configured to change a force with which the first rotator and the second rotator are pressed against each other by selecting at least one of the first urging unit and the second urging unit when the first rotator and the second rotator are pressed against each other.

8. A fixing device comprising:

a first rotator, a second rotator configured to contact the first rotator to form an interposition region in which a recording medium is interposed between the first rotator and the second rotator, and a pressing mechanism configured to press the first rotator and the second rotator against each other, wherein a force with which the pressing mechanism presses the first rotator and the second rotator against each other is changed by a change mechanism mounted to an image forming apparatus body, and the fixing device is removably mounted to the image forming apparatus body, wherein the pressing mechanism includes a movable member that is movable by action of the change mechanism, wherein the change mechanism is configured to change the force with which the pressing mechanism presses the first rotator and the second rotator by moving the moveable member in a direction away from the first rotator when the changing member is in an engaged state, and wherein the movable member is released from a target of the pressing operation.

* * * * *